US006588773B1

(12) United States Patent
Van Riet et al.

(10) Patent No.: US 6,588,773 B1
(45) Date of Patent: Jul. 8, 2003

(54) BINDING FOR A SNOWBOARD OR THE LIKE

(76) Inventors: Peter Gaston Nadia Van Riet, Graaf van Egmontstraat 35., B-2000 Antwerpen (BE); Herman Joannes Maria Van den Keybus, Bredabaan 238, B-2990 Wuustwezel (BE)

( * ) Notice: Subject to any disclaimer, the term of this patent is extended or adjusted under 35 U.S.C. 154(b) by 0 days.

(21) Appl. No.: 09/367,875

(22) PCT Filed: Feb. 24, 1998

(86) PCT No.: PCT/BE98/00025

§ 371 (c)(1),
(2), (4) Date: Sep. 7, 1999

(87) PCT Pub. No.: WO98/39070

PCT Pub. Date: Sep. 11, 1998

(30) Foreign Application Priority Data

Mar. 4, 1997 (BE) ..... 9700194
Nov. 17, 1997 (BE) ..... 9700918

(51) Int. Cl.[7] ..... A63C 9/00
(52) U.S. Cl. ..... 280/14.22; 280/624
(58) Field of Search ..... 280/14.21, 14.22, 280/613, 624, 625, 626, 634

(56) References Cited

U.S. PATENT DOCUMENTS 4,979,760 A * 12/1990 Derrah ..... 280/14.2
5,857,700 A * 1/1999 Ross ..... 280/14.22
5,957,479 A * 9/1999 Bayer et al. ..... 280/624
6,076,848 A * 6/2000 Rigal et al. ..... 280/634
6,123,354 A * 9/2000 Laughlin et al. ..... 280/624

FOREIGN PATENT DOCUMENTS

CH 000093314 A * 3/1922 ..... 280/624
DE 019524457 A1 * 1/1997

* cited by examiner

*Primary Examiner*—Robert P. Olszewski
*Assistant Examiner*—Elaine Gort
(74) *Attorney, Agent, or Firm*—Bacon & Thomas, PLLC

(57) ABSTRACT

A snowboard binding has at least two substantially rigid elements separate from one another and pivotably positioned on opposite lateral sides of an instep zone of a user's boot or footwear. The movable elements include press-on elements to reduce pressure exerted onto the boot by the movable elements. The movable elements are further connected to control elements that permit the movable elements to pivot and cooperate to separately retain a respective side of the instep zone of the boot.

29 Claims, 5 Drawing Sheets

1
5
10
32
16
9
26
30
17
8
14
21
18
12
18
20
13
17
7
30
26
9
15
17
10
18
4
31
19
2
F2

26
30
27
IV
28
15
IV
24
23
22
25
7
13
29
12
2

BINDING FOR A SNOWBOARD OR THE LIKE

BACKGROUND OF THE INVENTION

1. Field of Art

The present invention concerns a binding for a snowboard or the like. In the first place, it is meant for a snowboard, but in a more general way it can also be used for other applications such as for example a mono-ski.

2. Description of the Prior Art

It is known that for realizing a binding with a snowboard, in other words for making a connection between one of the boots of the user of the snowboard and the snowboard itself, use can be made of ribbons which are tightened over the front part of the boot, in particular the instep. These ribbons, called straps, are attached to a basic part which is fixed on the actual snowboard and which is equipped with a heel support. This known binding is disadvantageous in that it is time-consuming to use. Another disadvantage consists in that large pressure forces are exerted on the central part of the instep. Since a number of sensitive bones and blood vessels are situated in the central part, the use of such a binding can easily cause injuries.

According to another known technique, such a binding consists of latches which can cooperate with parts that have been specially provided on the sole of the boot. A disadvantage of this technique consists in that not every boot fits in every binding. An example hereof is disclosed in the German utility model no. 295 00 862.

German patent application no. 195 24 457 discloses a binding which is provided with one movable element in the form of a clip, which from one lateral side can be turned over the boot in order to clamp the latter at the height of the instep. In order to actuate said element, the latter is provided with a lever arm fixedly mounted to said element.

German patent application no. 295 20 277 discloses a binding which is provided with one movable element in the form of a clip which can be turned upward and downward in a forward direction, by pivoting it around the tip of the binding. In order to actuate said element, the latter is provided at its lower side with a lever arm which is fixedly mounted to said element.

Due to the use of only one clip-like element which is provided with an actuation lever fixedly mounted thereto, the bindings disclosed in DE 195 24 457 and DE 295 20 277 show the disadvantage that it is not possible to provide an efficient clamping action. The reason herefore consists in that the distance between the actuation lever and the movable element has to be large enough to enable the boot to be slit between the actuation lever and the movable element. As, after closing the binding, the distance between the actuation lever and the movable element remains unchanged, no pressing on occurs.

SUMMARY OF THE INVENTION

The invention aims a binding for a snowboard which has been improved in relation to the embodiments known until now and which, in a preferred embodiment, also offers a solution for the above-mentioned disadvantages of the known bindings.

To this end, the invention provides a binding for a snowboard or such, whereby this binding makes it possible to fix a boot or any other footwear on a snowboard, characterized in that it is provided with at least two movable elements which mesh from opposite lateral sides over the boot or footwear as a clip and co-operate with the boot or footwear on the place of the instep.

By an element which meshes over the boot as a clip is in the first place meant an element which assumes a well defined or rather well defined shape when locked according to the invention, in other words not a very flexible element such as a strap. By "as a clip" is meant that the element envelops the boot partly or entirely in the closed position of the binding.

In particular, by such element is meant a structure which is composed of rigid or relatively rigid (i.e., substantially inflexible) parts or parts with little flexibility, as compared with a user's boot or footwear located in the binding.

By using two elements instead of only one element, each of the elements needs to envelop the boot over only are relatively short distance, which offers the advantage that the movement of these elements is not influenced by the presence of the boot.

According to the most preferred embodiment the two elements are located at the opposite lateral sides of the binding and during opening can be moved sideward. In a particular embodiment this movement is obtained in that the elements can hinge laterally.

According to a preferred embodiment, the binding is provided with press-on elements allowing that a pressure force in the central part of the instep is excluded.

Preferably, the binding will also be provided with a step-in system, also simply called "step-in".

Further, the binding according to the invention may have one or several of the characteristics described in the following description and claims, whereby these characteristics can be combined at random.

The invention also concerns a snowboard equipped with such bindings.

DESCRIPTION OF THE DRAWINGS

In order to better explain the characteristics of the invention, the following preferred embodiments are described as an example only without being limitative in any way, with reference to the accompanying drawings, in which.

DETAILED DESCRIPTION OF THE PREFERRED EMBODIMENT

Figure 1:
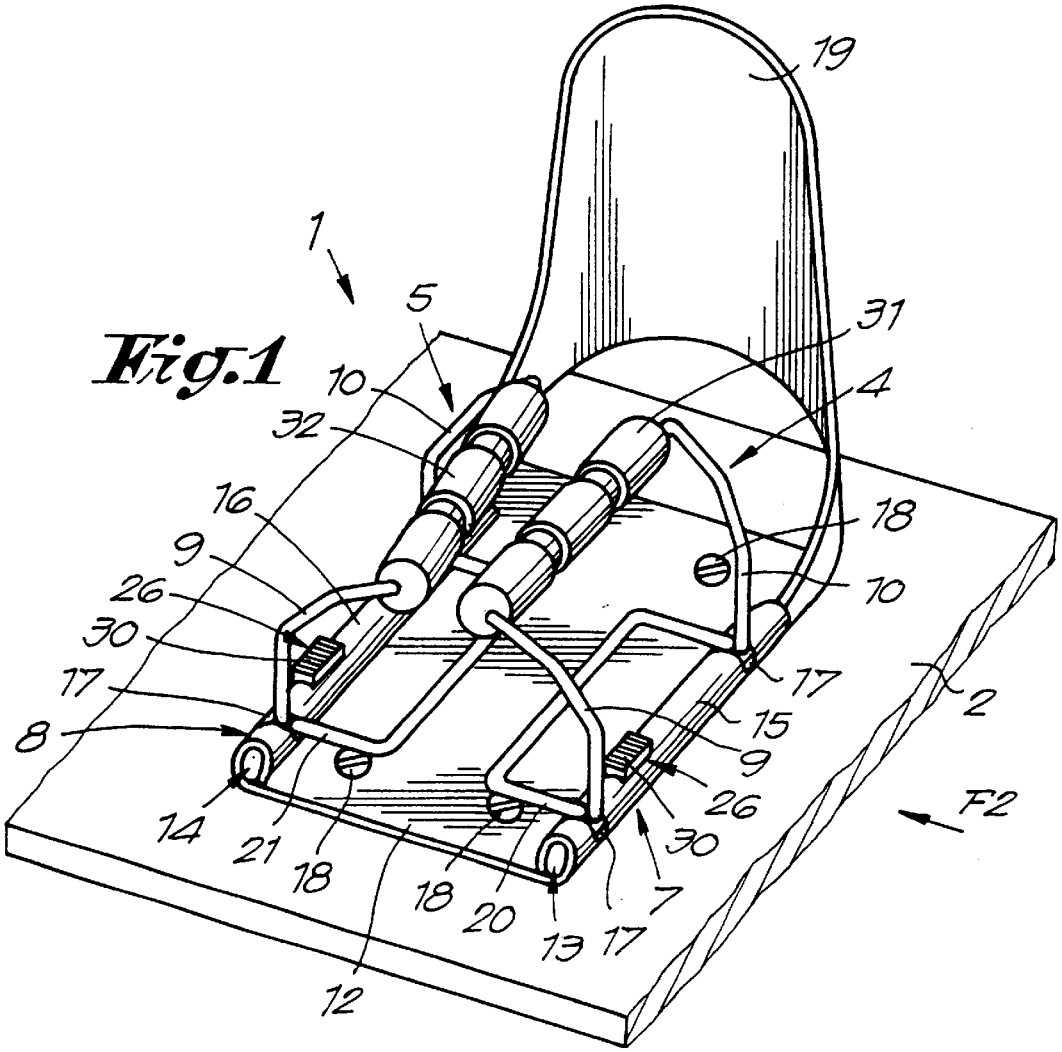
FIG. 1 shows a binding according to the invention in perspective.
Figures 2, 4:
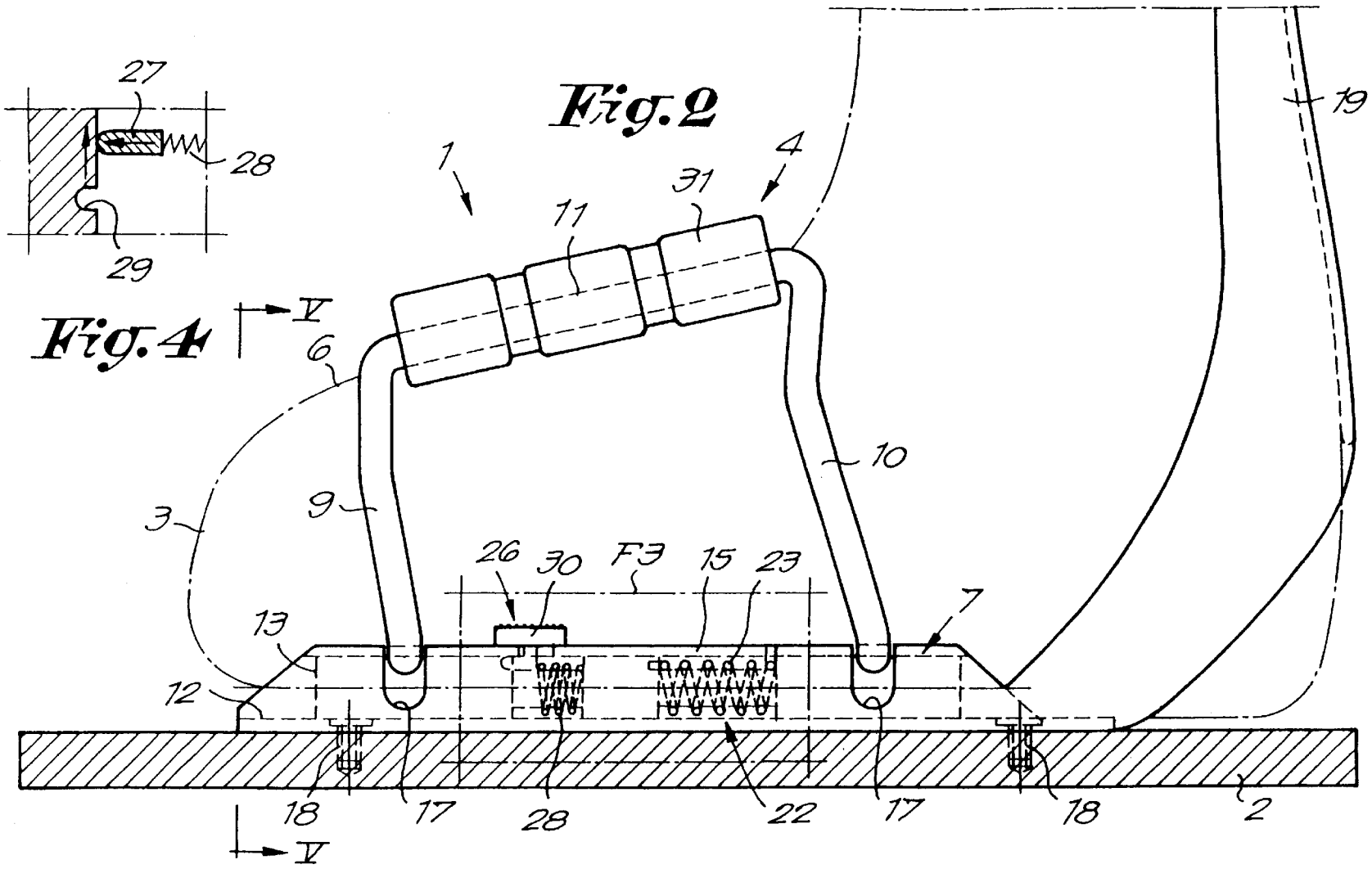
FIG. 2 shows a view according to arrow F2 in FIG. 1 to a larger scale.
FIG. 4 shows a section according to line IV—IV in FIG. 3.

As represented in FIGS. 1 and 2, the invention concerns a binding 1 for a snowboard 2. As is known, such a binding 1 is designed to form a connection between a boot 3 of the user and the actual snowboard 2.

A shown in FIGS. 1 to 5, according to the preferred form of the invention, the binding 1 is provided with at least two elements 4–5 which mesh or fit over the boot 3 as a clip at the top of the instep 6.

Figure 5:
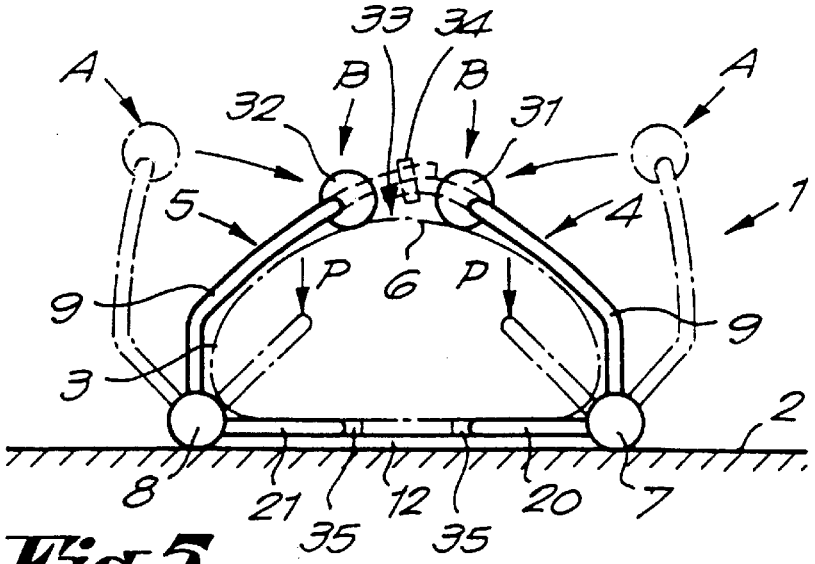
FIG. 5 shows a schematic section according to line V—V in FIG. 2 to a smaller scale.

The elements 4 and 5 can be laterally moved, in particular hinged, between an open position and a closed position as is indicated in FIG. 5 with A and B respectively. These elements 4 and 5 can hereby be hinged around hinge points 7–8 which are situated at the bottom on the sides of the binding 1.

As represented, the elements 4 and 5 each preferably consist of a clip, formed of two legs 9–10 which, when the binding 1 is closed, extend over a part of the boot 3 and a connecting piece 11 connecting the legs 9–10 with one another, extending in the longitudinal direction of the instep 6, and preferably rising somewhat obliquely from the front to the back. The connecting pieces 11 preferably also diverge somewhat from the front to the back.

The hinge points 7–8 are provided on a base plate 12 which is also part of the binding 1. In the example, the hinge points 7–8 are formed of shafts 13–14 onto which the legs 9–10 are fixed, whereby these shafts 13–14 are hinge-mounted in seatings 15–16 provided on the edges of the base plate 12. In these seatings 15–16 are provided grooves 17 which make it possible for the legs 9–10 to rotate.

The base plate 12 makes it possible to fix the binding 1 on the snowboard 2, for example by means of screws 18 or in any other way whatsoever. It is clear that this baseplate 12 can also be replaced by a frame. According to another variant, the base plate 12 can be omitted and the hinge points 7–8 can each be provided separately to the snowboard 2.

The binding 1 further includes a heel support 19, preferably in the shape of what is called a spoiler. A fixed heel support 19 will preferably be used.

As the example of FIGS. 1 to 5 further indicates, the binding 1 is preferably carried out as an step-in binding, by which is meant that the binding 1 is closed by exerting a pressure force on it via the boot 3.

Also, the binding 1 is provided with actuation or control members, in particular lever arms 20–21, with which the binding can be put from the open position A in the closed position B by means of a pressure force exerted by the bottom side of the boot 3. Also, these lever arms 20–21 are situated directly above the base plate 12. In the example shown, they consist of U-shaped clips which are fixed to the shafts 13–14 at the height of the above-mentioned grooves According to the embodiments of FIGS. 1 to 5, the binding 1 is also equipped with elastic means 22 which force the binding 1 in the opened position. In the example, these means 22 are provided on the hinge points 7–8, and in particular they are integrated in these hinge points 7–8.

Figure 3:
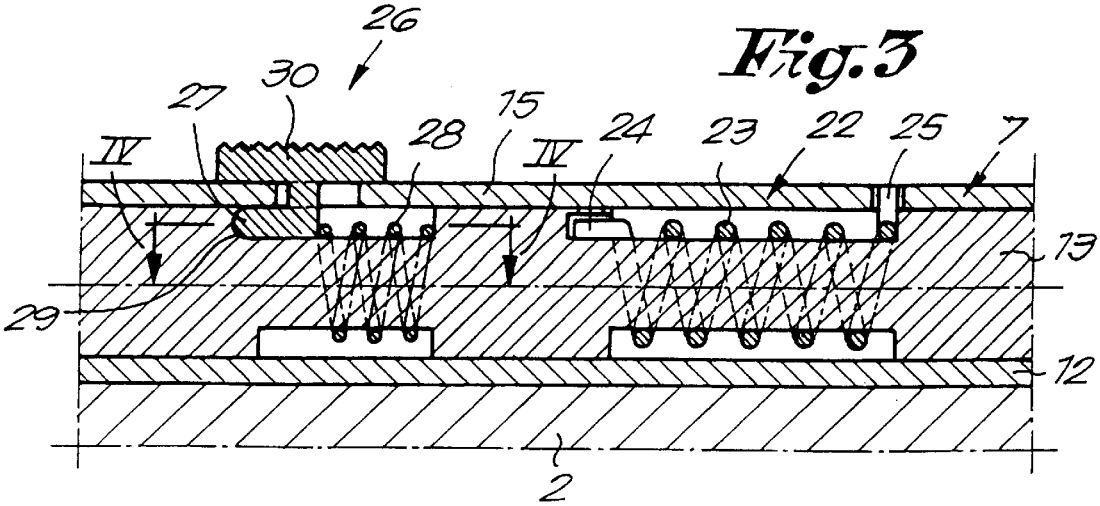
FIG. 3 shows a section of the part which is indicated in FIG. 2 with F3.

In particular, these elastic means 22, as represented in FIG. 3, consist of a torsion spring 23 which is fixed to the shaft 13,14 respectively with one end 24, and which is fixed to the fixed part of the corresponding hinge point 7 or 8 with its other end 25, in other words to the seating 15 or 16.

Further, the binding 1 is provided with locking means 26 which retain the binding 1 in a closed position during its use. According to the embodiment of FIGS. 1 to 5, these locking means 26 consist of an element 27 which is automatically locked when the binding 1 is closed, for example due to a compression spring 28 which forces the element 27 in a seating 29. The element 27 is provided with a control element 30 which makes it possible to unlock the element 27 against the force of the compression spring 28.

The binding 1 according to the invention, as represented in the examples shown, is preferably provided with press-on elements 31–32 which leave at least the central part 33 of the instep 6 free of pressure when in use.

In fact, these press-on elements 31–32 may be formed of connecting pieces 11, but they will preferably consist of elements which are provided on the connecting pieces 11 to this aim. These press-on elements 31–32 preferably consist of a rather flexible and/or compressible material, for example rubber, or even a more flexible material such as synthetic foam.

These press-on elements 31–32 are also carried out such that a support is formed at least right and left of the instep 6.

In particular, the press-on elements 31–32 extend in the longitudinal direction of the binding 1 as represented, in other words in the longitudinal direction of the foot of the user of the snowboard 2, such that a support is provided in different places in the longitudinal direction.

The binding 1 is provided with means to alter the press-on pressure supplied by the press-on elements 31–32, to change their position respectively. To this end, the press-on elements 31–32 are cylinder-shaped and are situated eccentrically around the connecting pieces 11, such that the pressure force can be altered by putting the press-on elements 31–32 in another angle position in relation to the connecting pieces 11. In order to make sure that the press-on elements 31–32 cannot turn during use, locking means which are not represented in the figures can be provided between the connecting pieces 11 and the elements 4–5.

The working and the use of the binding 1 is mainly as follows. In the first instance, the elements 27 are put in the unlocked position, so that the elements 4–5 end up in the positions A as represented in FIG. 5. By placing a foot with a boot 3 in the binding 1, a force P is exerted on the lever arms 20–21, so that the elements 4–5 rotate inwardly and end up in the position B, whereby the press-on elements 31–32 clamp the boot 3 near the instep 6.

At the moment the lever arms 20–21 are pressed entirely down, the element 27, with the help of the compression spring 28, will mesh in the seating 29, which has for a result that the elements 4–5 remain locked in the position B, after which the snowboard 2 is ready for use.

The binding 1 can be released by shifting the element 27 by means of the control element 30 and by simultaneously lifting the foot a little. As soon as the element 27 is unlocked, the elements 4–5 are opened with the help of the torsion springs 23 which are situated in the hinge points 7–8.

According to a variant which is not represented in the figures, the elastic means 22 can also be omitted, whereby only locking means 26, in the above-mentioned form or in any other form whatsoever, are used.

According to yet another possibility instead of elastic means 22 which force the binding 1 in the opened position, elastic means can be used which force the binding 1 in a closed position, whereby a locking in the closed position can possibly be omitted, on condition that the elastic clamping force provides a sufficiently large closing force. In this case, the binding 1 can possibly be provided with a control element, for example a lever mechanism that is operated manually, to open this binding. A locking mechanism can be provided in this case, however, with which the binding 1 can be locked in the open position, such that it is possible to step into the binding 1.

It should be noted that in the last described embodiment, the elements 4–5 can be either or not provided with stop means which determine the end position of these elements 4–5 in the closed position. In case such stop means are provided, the elements 4–5 will assume a specific position when closed. The stop means may hereby consist of the above-mentioned lever arms 20–21 whose movement is restricted by the base plate 12. In case no stop means are provided, it will be the elastic means which determine the clamping force exerted on the boot 3.

It should be noted that the above-mentioned locking means 26 can be of different nature and that they do not necessarily have to be integrated in the hinge points 7–8. Thus, a variant is for example schematically represented in FIG. 5 in which locking means 34 are provided with which the two above-mentioned element 4–5 can be connected to one another over the instep 6. Such locking mechanisms 34 may for example consist of parts which mesh or such, or they may also consist of straps or such with which the elements 4–5 can be tied together. As indicated by reference 35 in FIG. 5, use could also be made of locking means which provide for a locking between the lever arms 20–21 and the base plate 12. They can then for example be unlocked by means of a control element which is not represented here. It is clear that in the embodiments of FIGS. 1 to 5, the elements 4–5 can be turned open such that a sufficiently large space is created to put a foot with a boot 3 between these elements 4–5.

Figure 6:
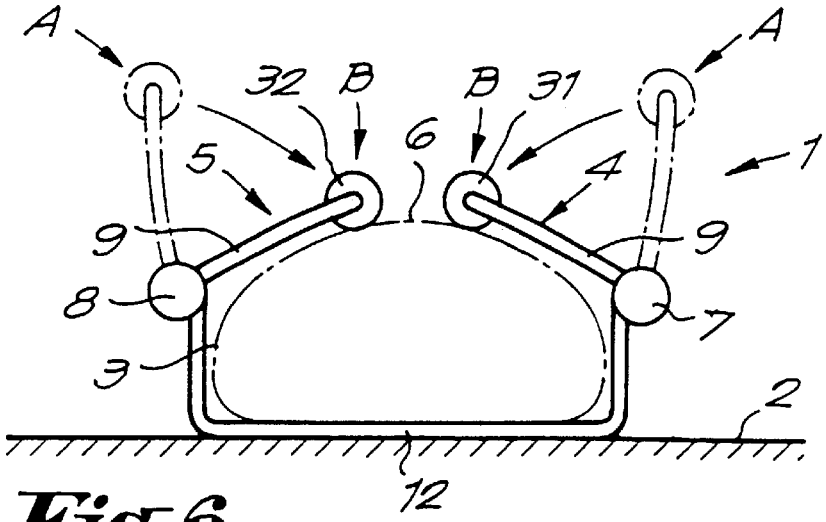
FIG. 6 shows a schematic view for a variant, similar to that of FIG. 5.

It should be noted that the hinge points 7–8 must not necessarily be situated at the bottom. FIG. 6 schematically represents a variant in which these hinge points 7–8 are situated at a distance above the base plate 12 or such.

The embodiment of FIG. 6 which is schematically represented also shows that the lever arms 20–21 are optional and thus can be omitted.

It is clear that also the embodiment of FIG. 6, according to a variant which is not represented here, can be provided with control elements which make sure that the binding 1 is locked by putting a boot 3 in it and pressing it down.

Finally, it should be noted that the elements which envelop the boot 3 do not necessarily have to be hinge-mounted, but that also other mechanisms of movement can be provided while still remaining within the scope of the invention.

It should be noted that, according to a variant, the locking mechanisms 26 of the two elements 4–5, can be combined, such that only one control element instead of two control elements 30 has to be actuated.

Figure 7:
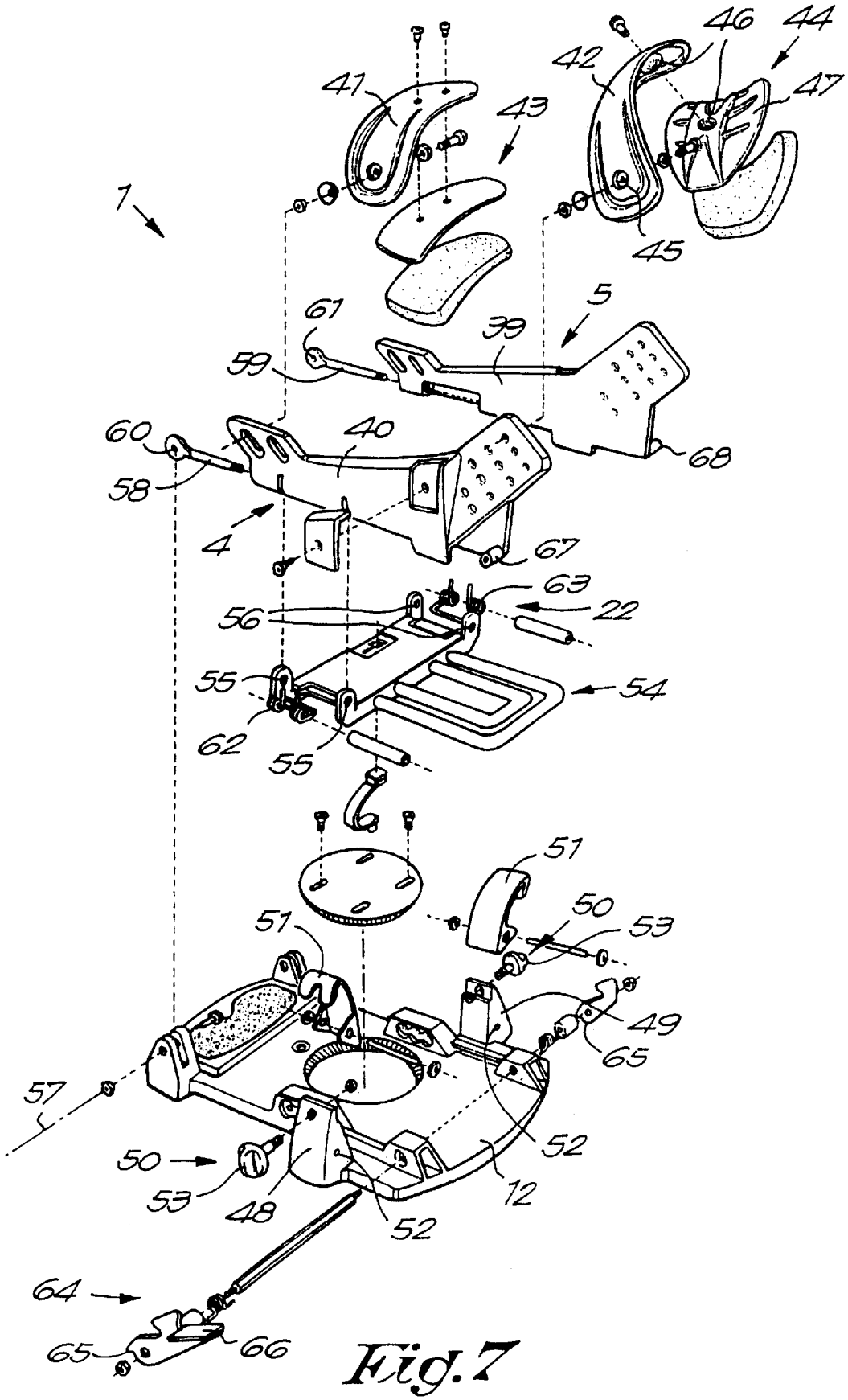
FIG. 7 shows a disassembled variant, whereby only a limited number of parts are represented.
Figure 8:
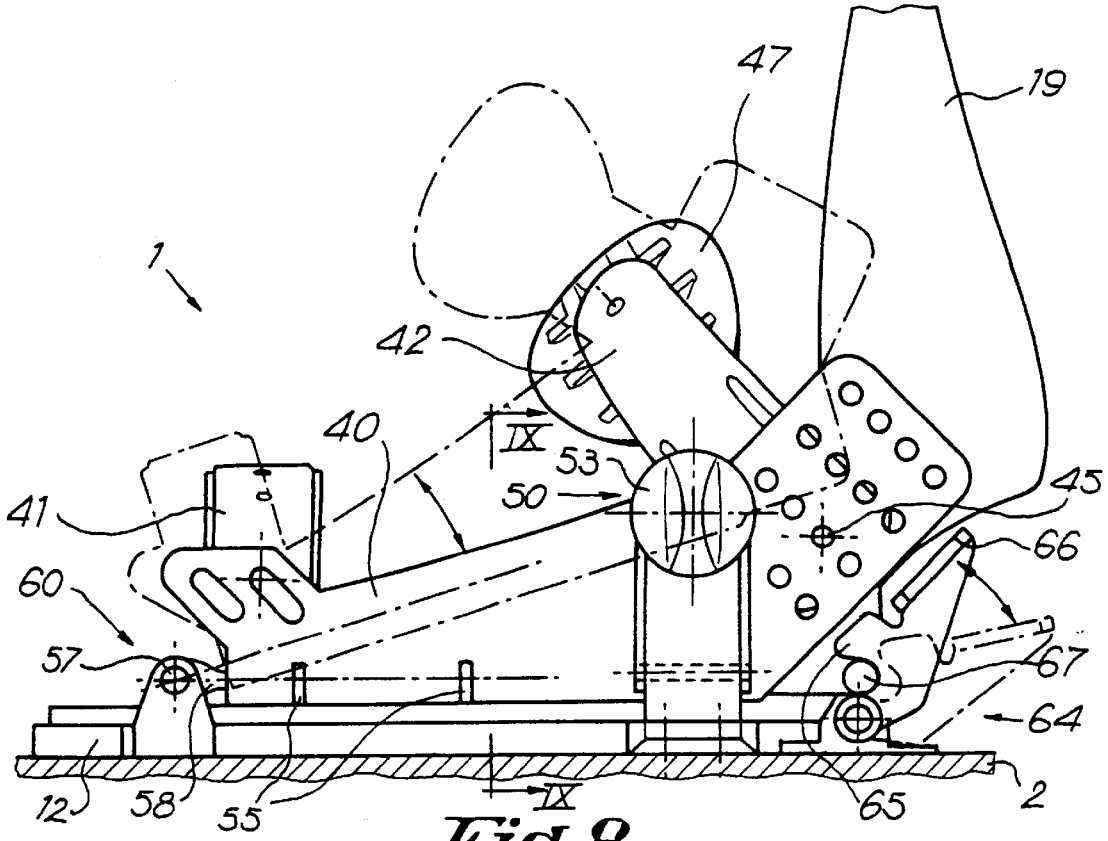
FIG. 8 shows the binding of FIG. 7 from a side view, in a more complete situation.
Figure 9:
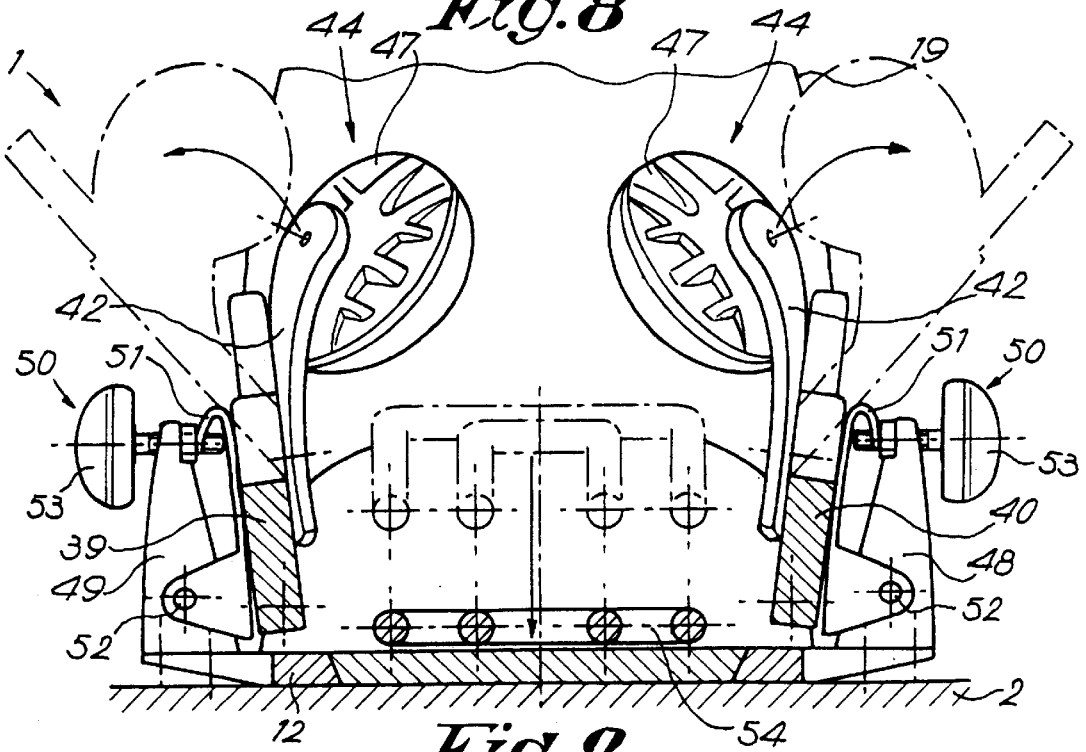
FIG. 9 shows a section according to line IX—IX in FIG. 8.

FIGS. 7 to 9 represent a special embodiment in which the movement of the elements 4 and 5 differs from the movement of the press-on actuation member, as opposed to the mechanisms represented in FIGS. 1 to 5, whereby the angular displacement of the elements 4–5 always coincides with the angular displacement of the lever arms 20 and 21. This offers the advantage that the press-on-elements, which will be further described hereafter, only close around the boot 3 at the end of the closing motion of the press-on actuation member.

The binding 1 is hereby provided with elements 4 and 5, consisting of basic parts 39–40, which are each provided with two arms 41 and 42 which mesh over the boot 3 as a clip, which basic parts 39–40 can be swung aside as a result of the rotation of the elements 4–5.

Both on the front arms 41 and on the rear arms 42 are provided press-on elements 43–44.

As represented in FIG. 7, according to the invention, at least the rear press-on elements 44, in other words the press-on elements which are situated at the top portion of the instep 6, are provided on parts, in this case the arms 42, which can be at least hinged somewhat to the front and to the back, such that the position of these parts, and thus of the press-on elements 44 will automatically adjust to the shape of the boot 3. To this end, the arms 42 are fixed to the basic parts by means of hinge points 45.

The press-on elements 44 can also move as such, on the one hand because they are fixed to the arms 42 in a moveable manner, in this case by means of a ball joint 46, and on the other hand because they are provided with a supporting plate 47 made of a relatively hard but nevertheless flexible material, for example relatively hard plastic. It is clear that, instead of the combination of such a moveable attachment with a flexible support, one can also provide for only either of the two.

Further, the binding is provided with supports 48–49 whose top sides form guides for the elements 4–5 as they snap open and close again. These supports 48–49 are provided on the base plate 12 on the outside of the elements 4 and 5 or formed as one piece with it.

Figure 10:
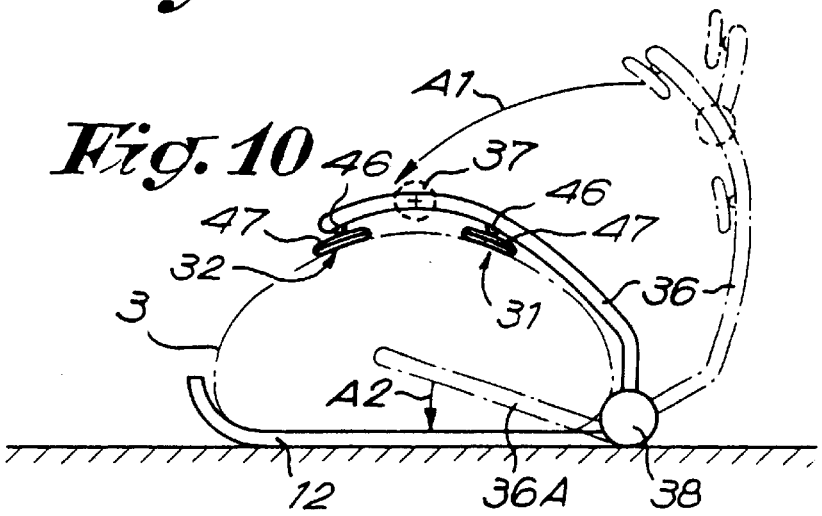
FIG. 10 shows a variant.

The above-mentioned guides are provided with adjusting means 50 with which the position and thus the press-on force of the above-mentioned press-on elements 43–44 on the boot 3 can be adjusted. These adjusting means 50 consist of moveable parts, in particular sliding shoes 51 provided on the supports 48–49 by means of hinges 52 and which, as represented in FIG. 10, can be more or less pressed to the inside by means of adjusting screws 53.

Further, the binding 1 is provided with an actuation or control member in the shape of a support 54 which is fixed between the elements 4–5 by means of hinge points 55–56 and onto which a pressure force can be exerted with the boot 3. The elements 4–5 are, together with the above-mentioned support 54, fixed to the base plate 12 near their front end in a rotatable manner, such that the whole can be rotated around a shaft 57 which extends diagonally in relation to the longitudinal direction of the binding. The attachment consists of pivots 58–59 forming rotary shafts for the hinge points 55–56 on the one hand, and which can be rotated around the shaft 57 by means of hinge points 60–61 on the other hand.

In the example of FIGS. 7 to 9, the elastic means 22 consist of springs 62–63 which push the above-mentioned elements 4–5 laterally open in relation to the above-mentioned. support 54. Locking means 64 with locking hooks 65 and an unlocking lever 66 make sure that the binding 1 is fixed when closed as the basic parts 39–40 with pens 67–68 provided upon them end up behind the hooks 65.

The working can be easily derived from the FIGS. 8 and 9. In open position, the parts of the binding 1 are as represented by the dashed line. By putting a foot with a boot 3 in the binding and by pressing the support 54 down, the parts 4–5 are forced to hinge inward as they make contact with the sliding shoes 51. When the support 54 is pressed entirely down, the hooks 65 mesh around the pens 67–68, so that the binding 1 is locked.

By interrupting the interlock by operating the unlocking lever 66 and by lifting the foot with the boot 3 at the heel, the elements 4–5 are forced to rotate outward due to the force of the springs 62 and 63, as a result of which they slide over the supports 48–49, so that the whole is also raised around the shaft 57 as the binding 1 opens.

It is clear that, instead of the supports 48–49, also other guiding means and closing mechanisms can be provided.

The characteristic of the latter embodiment whereby the binding contains a hinge-mounted system which can be rotated around the front end of the binding can also be realized in other ways. Such a hinge-mounted system is particularly practical, by which is meant that the user can easily step in and out of bindings provided with such a system.

It should be noted that the present invention also relates to bindings which are provided with only one movable element, such as the element 36 in FIG. 10, whereby in order to provide for a binding which does not show the disadvantages of the known bindings, the binding of the invention is provided with transmission means between the control member 36A and the movable element 36, which transmission means are schematically indicated by element 38, whereby these transmission means 38 provide in a movement of the movable element 36 which is different from the movement of the control or actuation member 36A. With the latter is meant that for example the element 36 moves over an angle A1, whilst displacing the member 36A over an angle A2, which is smaller than the angle A1. In this way, the boot 3 can easily be slit into the opened binding, whilst upon closing the binding a clamping force can be created.

The element 36 may be mounted laterally of the binding as shown in FIG. 10, but, when using such transmission means 38, may also be installed at another location, for example in front of the boot 3.

Of course such transmission means may also be provided in the bindings of the invention which make use of two or more movable elements 4–5.

The feature according to which the binding is provided with press-on elements which are made such that they can move, either because they are attached in a movable manner, or because they are provided with a support plate made of a relatively hard but nevertheless flexible material can, according to the invention, applied in the embodiments having two or more movable elements 4–5, as well as in embodiments having only one movable element 36. These plates 47 and the ball joints 46 providing in said movement are indicated in FIG. 10 as well.

According to still another possibility of the invention, in order to allow that a good clamping action can be obtained by only one movable element, an extra hinge point 37 can be provided between the press-on elements 31–32, for example as shown in FIG. 10, which may or may not be combined with the above described transmission means 38. In the latter case, the press-on element 32 can be pressed on first and subsequently the press-on element 31, whereby the necessary lockings are provided in the eventual hinge point 38 and in the hinge point 37 to prevent them from turning back.

According to the invention the feature according to which press-on elements are used which leave at least the central part of the instep 6 free of pressure can apply in the embodiments having to or more movable elements 4–5, as well as in the embodiments having only one movable element 36.

The present invention is by no means limited to the embodiments described as an example and represented in the accompanying drawings; on the contrary, such a snowboard or such can be made in various forms and dimensions while still remaining within the scope of the invention.

What is claimed is:

1. A binding adapted to attach a user's boot having front and rear sections received in the binding to a snowboard, the binding having lengthwise and lateral dimensions, said binding comprising:

at least two substantially inflexible movable elements laterally separate from each other and pivotably positioned on opposite lateral sides of the binding;

said elements operable so as to pivot about generally lengthwise extending pivot axes and cooperate to individually engage and retain there between a user's boot by extending over a respective lateral side portion and at least a part of a top portion of the front section of a user's boot received centrally in the binding when each of said elements is in a closed position.

2. The binding according to claim 1 wherein said movable elements include press-on elements configured to engage a user's boot received in the binding, said press-on elements located and arranged so as to distribute pressure on a user's boot received in the binding resulting from engagement of said elements with a user's boot to thereby generally avoid application of pressure to a central top portion of a front section of a user's boot exerted by said binding.

3. The binding according to claim 2 wherein said press-on elements are arranged to generally conform to a shape of a user's boot.

4. The binding according to claim 2 wherein said press-on elements comprise resilient material.

5. The binding according to claim 1 further comprising a control member actuatable by a user's boot and connected to said elements to cause said elements to pivot and engage a user's boot received in the binding in a retaining relationship when actuated by a user's boot received in the binding.

6. The binding according to claim 5 wherein said control members comprise at least one lever arm cooperating with said movable elements and positioned along a bottom portion of said binding.

7. The binding according to claim 6 further comprising guides arranged to guide each said movable elements between an open and a closed position.

8. The binding according to claim 7 wherein said guides comprise standing supports positioned on laterally opposed sides of said binding.

9. The binding according to claim 7 wherein said guides include an adjustment device arranged to enable adjustment of the position of said movable elements.

10. The binding according to claim 7 wherein said control member is mounted between said movable elements, said binding further including an elastic device including springs arranged to bias said movable elements laterally towards an open position when a user's boot is not received in the binding.

11. The binding according to claim 5 wherein the control member comprises a lever arm connected to said movable elements.

12. The binding according to claim 1 wherein the movable elements are hingedly mounted to said binding.

13. The binding according to claim 1 further comprising an elastic device arranged to normally urge said movable elements of said binding towards an open position out of engagement with a user's boot.

14. The binding according to claim 1 further comprising a locking device operable to secure said movable elements of said binding in a closed position in engagement with a user's boot.

15. The binding according to claim 14 wherein the locking device further comprises a locking element adapted to lock said binding when said binding is in a closed position, and wherein said locking element is arranged with a control element adapted to unlock said locking element to enable said binding to move into an open position.

16. The binding according to claim 14 wherein the locking device includes a locking mechanism connecting said two movable elements together against movement towards an open position.

17. The binding according to claim 14 wherein the locking device includes a securing device that secures the movable elements together, said locking device comprising a part arranged to lock the movable elements together in a position for retaining a user's boot.

18. The binding according to claim 17 wherein the locking device includes a strap connection.

19. The binding according to claim 17 wherein the locking device includes meshing parts which are configured to mesh with one another.

20. The binding according to claim 1 including a base plate, and wherein said movable elements are connected to said base plate, said movable elements being rotatably connected to said base plate by a shaft extending transversely in relation to the longitudinal direction of the binding.

21. The binding according to claim 1 further comprising a base plate enabling attachment of the binding to a snowboard, and a fixed heel support connected to said base plate.

22. The binding according to claim 1 further comprising:

at least one control member arranged to be actuated by placement of a user's boot in the binding to actuate said movable element to a position for exerting pressure onto a user's boot; and a transmission device arranged between said control member and said movable element, said transmission device connected to said control member and adapted to urge said movable element between an open and a closed position.

23. A binding for a snowboard adapted to attach a user footwear thereto comprising:

at least one substantially inflexible movable arm positioned along a lateral side of the binding and adapted to engage and retain a user footwear received in the binding in a closed position, said movable arm in said closed position extends fully over a lateral side of a user footwear and only a part of a top portion of a user footwear, said at least one movable arm includes a first hinge point and a second hinge point.

24. A binding for a snowboard adapted to attach a user footwear thereto comprising:

at least one substantially inflexible movable element positioned along a lateral side of the binding and adapted to engage and retain a footwear received in the binding in a closed position, said movable element in said closed position extends fully over a lateral side and only a part of a top portion of a user footwear; and at least one press-on element having a support plate of a substantially hard and flexible material connected to said movable element.

25. A binding for a snowboard adapted to attach user footwear thereto comprising:

at least one substantially inflexible movable element positioned along a lateral side of the binding and adapted to engage and retain user footwear received in the binding, said movable element in said closed position extends fully over a lateral side and only a part of a top portion of a front section of a user footwear; and at least one press-on element connected to said at least one movable element, said press-on element dimensioned and configured to absorb pressure on a top portion of a user footwear.

26. A binding for securing a user footwear to a snowboard, comprising:

at least one substantially inflexible clip element moveable so as to be engageable with and extend over a top portion of a user footwear in a front section thereof when in a closed position and when a user footwear is located in the binding;

at least one control member linked to the clip element, said control member arranged to be engaged by a user footwear placed in the binding and urge the clip element to said closed position;

a motion transmission device operatively connected to and between the clip element and the control member, wherein said motion transmission device is arranged to urge greater angular translation of the clip element than angular translation of the control member when a user footwear actuates the control member as a user footwear is received in the binding.

27. A binding for securing a user footwear to a snowboard, comprising:

at least one substantially inflexible moveable clip element moveable so as to engage and fit over a top portion of a user footwear of a front section thereof when in a closed position and when a user footwear is located in the binding, said moveable clip element individually retaining a user footwear when in said closed position;

at least one press-on element connected to the moveable clip element at a position enabling the press-on element to engage at least a part of a top portion of a front section of a user footwear received in the binding;

said at least one press-on element including at least a portion moveable relative to the moveable clip element so as to be self-adjusting to a user footwear.

28. A binding adapted to attach a user's boot having front and rear sections received in the binding to a snowboard, the binding having lengthwise and lateral dimensions, and comprising:

at least two movable elements laterally separate from each other and pivotably positioned on opposite lateral sides of the binding;

wherein said elements are operable so as to pivot between open and closed positions, and said elements cooperate to individually engage and retain therebetween a user's boot by extending over a respective lateral side portion and at least part of a top portion of a front section of a user's boot received centrally in the binding when in a closed position;

wherein said binding further comprises a control member actuatable by a user's boot and connected to said elements to urge the elements to pivot into said closed position by engaging a user's boot when actuated by a user's boot received in said binding.

29. The binding according to claim 28, further comprising a locking device arranged to secure the movable elements relative to one another in the closed position.

* * * * *